US010351941B2

(12) United States Patent
Kawakami et al.

(10) Patent No.: US 10,351,941 B2
(45) **Date of Patent: *Jul. 16, 2019**

(54) α+β TITANIUM ALLOY COLD-ROLLED AND ANNEALED SHEET HAVING HIGH STRENGTH AND HIGH YOUNG'S MODULUS AND METHOD FOR PRODUCING THE SAME

(71) Applicant: NIPPON STEEL & SUMITOMO METAL CORPORATION, Tokyo (JP)

(72) Inventors: Akira Kawakami, Tokyo (JP); Kazuhiro Takahashi, Tokyo (JP); Hideki Fujii, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 234 days.

This patent is subject to a terminal disclaimer.

(21) Appl. No.: 15/110,033

(22) PCT Filed: Apr. 9, 2015

(86) PCT No.: PCT/JP2015/061114

§ 371 (c)(1),
(2) Date: Jul. 6, 2016

(87) PCT Pub. No.: WO2015/156356

PCT Pub. Date: Oct. 15, 2015

(65) Prior Publication Data

US 2016/0326620 A1 Nov. 10, 2016

(30) Foreign Application Priority Data

Apr. 10, 2014 (JP) ..... 2014-081049

(51) Int. Cl.
*C22F 1/18* (2006.01)
*C22C 14/00* (2006.01)
(Continued)

(52) U.S. Cl.
CPC ..... *C22F 1/183* (2013.01); *B21B 1/26* (2013.01); *B21B 1/28* (2013.01); *C22C 14/00* (2013.01); *C22F 1/00* (2013.01); *C22F 1/18* (2013.01)

(58) Field of Classification Search
CPC ... B21B 1/26; B21B 1/27; C22F 1/183; C22F 1/00; C22F 1/18; C22C 14/00
See application file for complete search history.

(56) References Cited

U.S. PATENT DOCUMENTS 6,063,211 A 5/2000 Soeda et al.
2012/0234066 A1 9/2012 Takahashi et al.
(Continued)

FOREIGN PATENT DOCUMENTS

CN 103392019 A 11/2013
CN 103403203 A 11/2013
(Continued)

OTHER PUBLICATIONS

International Search Report (PCT/ISA/210) issued in PCT/JP2015/061114, dated Jul. 14, 2015.
(Continued)

*Primary Examiner* — Alexandra M Moore
(74) *Attorney, Agent, or Firm* — Birch, Stewart, Kolasch & Birch, LLP

(57) ABSTRACT

An object of the present invention is to provide an α+β titanium alloy cold-rolled and annealed sheet having a high strength and a high Young's modulus in the sheet width direction. A titanium alloy sheet in which, when the texture in the sheet plane direction is analyzed, the ratio XTD/XND between the X-ray relative intensity peak value (XTD) in directions close to the sheet width direction and the X-ray relative intensity peak value (XND) in directions close to the normal-to-sheet-plane direction on the (0002) pole figure of
(Continued)

REGIONS CORRESPONDING TO FIGS. 2 (b) AND 2 (c) IN (0001) POLE FIGURE OF TITANIUM α-PHASE the α-phase is 5.0 or more and which contains, in mass %, Fe: 0.8% to 1.5% and N: 0.020% or less and has an oxygen-equivalent Q of 0.34 to 0.55. Annealing of the titanium alloy sheet is performed at not less than 500° C. and less than 800° C. in the case where the cold rolling rate is less than 25% and at not less than 500° C. and less than 620° C. in the case where the cold rolling rate is 25% or more.

2 Claims, 3 Drawing Sheets

(51) Int. Cl.

| | |
|---|---|
| ***C22F 1/00*** | (2006.01) |
| ***B21B 1/26*** | (2006.01) |
| ***B21B 1/28*** | (2006.01) |

(56) References Cited

U.S. PATENT DOCUMENTS

| | | | | |
|---|---|---|---|---|
| 2013/0327448 | A1 | 12/2013 | Kawakami et al. | |
| 2013/0327449 | A1* | 12/2013 | Kawakami | C22C 14/00 148/501 |

FOREIGN PATENT DOCUMENTS

| | | | |
|---|---|---|---|
| CN | 103717766 | A | 4/2014 |
| JP | 10-265876 | A | 10/1998 |
| JP | 2000-204425 | A | 7/2000 |
| JP | 3426605 | B2 | 7/2003 |
| JP | 2008-127633 | A | 6/2008 |
| JP | 2008-240026 | A | 10/2008 |
| JP | 2009-179822 | A | 8/2009 |
| JP | 2009-215601 | A | 9/2009 |
| JP | 2010-031314 | A | 2/2010 |
| JP | 2010-121186 | A | 6/2010 |
| JP | 2012-132057 | A | 7/2012 |
| JP | 2013-079414 | A | 5/2013 |
| WO | WO 96/33292 | A1 | 10/1996 |
| WO | WO 2011/068247 | A1 | 6/2011 |
| WO | WO 2012/115242 | A1 | 8/2012 |

OTHER PUBLICATIONS

Ishiyama et al., "Plastic Deformation and Press Formability of C.P. Titanium Sheet", Titanium Japan, vol. 54, No. 1, Jan. 2006, pp. 42-51.

Office Action issued in Taiwanese Patent Application No. 104111425 dated Dec. 2, 2015.

Written Opinion (PCT/ISA/237) issued in PCT/JP2015/061114, dated Jul. 14, 2015.

Chinese First Notification of Reasons for Refusal and Search Report dated Apr. 27, 2017, for corresponding Chinese Applictaion No. 201580016128.X, with an English translation of the Office Action.

* cited by examiner

REGIONS CORRESPONDING TO FIGS. 2 (b) AND 2 (c) IN (0001) POLE FIGURE OF TITANIUM α-PHASE

α+β TITANIUM ALLOY COLD-ROLLED AND ANNEALED SHEET HAVING HIGH STRENGTH AND HIGH YOUNG'S MODULUS AND METHOD FOR PRODUCING THE SAME

TECHNICAL FIELD

The present invention relates to an α+β titanium alloy cold-rolled and annealed sheet having a high strength and a high Young's modulus in the sheet width direction and a method for producing the same.

BACKGROUND ART

An α+β titanium alloy has been in use for a long time as members of airplanes etc., with its high specific strength utilized. These days, the weight ratio of the titanium alloy used for airplanes is increasing, and the importance thereof is becoming higher and higher. Also in the consumer product field, an α+β titanium alloy having a high Young's modulus and a light specific gravity is increasingly used for golf club faces. In particular, in this use, since a thin sheet is used as the material in many cases, the need for a high-strength α+β titanium alloy thin sheet is high. Furthermore, a high-strength α+β titanium alloy is expected to be used also in automobile parts etc. in which weight reduction is regarded as important, and the need for a thin sheet, centering on a cold-rolled and annealed sheet, is increasing also in this field.

In the use of golf club faces, it is known that, when the direction in which a high strength and a high Young's modulus are exhibited in the sheet plane is used for the side of the short side of the face, the rebound regulation can be met and the durability is high. In this regard, when an α+β titanium alloy is subjected to unidirectional hot rolling, a texture called a transverse-texture (T-texture), in which the c-axis of the α-phase is strongly oriented in the sheet width direction, is exhibited where the α-phase is the main phase and exhibits a hexagonal closed packed (HCP) structure. At this time, in the α+β titanium alloy, the twinning deformation is suppressed and the slip direction of the primary slip system, which determines the plastic deformation, is limited in the bottom plane, and therefore the strength in the sheet width direction is increased in the case of having a T-texture. Thus, the rebound regulation is met and the durability is improved by using the sheet width direction of a unidirectionally hot-rolled sheet for the side of the short side of the face.

Patent Literature 1 discloses an α+β titanium alloy sheet that, while utilizing this phenomenon to attempt T-texture development and the accompanying improvement in strength and Young's modulus in the sheet width direction, has chemical components that prevent excessive development of a texture and the accompanying excessive strength increase and ductility reduction. Further, also for automobile parts, Patent Literature 2 discloses an automobile engine component and a material thereof in which cutting processing is performed such that the sheet width direction of an α+β titanium alloy sheet having a T-texture coincides with the axial direction of an engine component such as an engine valve or a connecting rod and thereby the strength and rigidity in the axial direction are increased. Both the technologies utilize a T-texture produced in an α+β titanium alloy unidirectionally hot-rolled sheet. However, in both the alloys, the amount of added Al, which reduces the cold ductility, is high, and cold rolling is difficult; hence, both the technologies are technologies in unidirectionally hot-rolled sheets, and production technology for a cold-rolled sheet of a smaller sheet thickness, for example a sheet thickness of 2.5 mm or less, has not yet been revealed.

On the other hand, for the α+β titanium alloy, there are proposed some α+β titanium alloys that allow a cold-rolled sheet to be produced. In Patent Literature 3 and Patent Literature 4, low-alloy-based α+β titanium alloys in which Fe, O, and N are used as main additive elements are proposed. By adding Fe as a β-stabilizing element and O and N as α-stabilizing elements, which elements are inexpensive, and adding O and N in amounts in appropriate ranges and with an appropriate balance, a balance of high strength and high ductility can be ensured. Since high ductility is provided at room temperature, it is presumed that a cold-rolled product can be produced. Further, in Patent Literature 5, while Al, which contributes to increasing the strength but reduces the ductility and reduces the cold processability, is contained, Si and C, which are effective in strength increase and yet do not impair the cold ductility, are added; thus, cold rolling is enabled. In Patent Literature 6 to Patent Literature 10, technologies in which Fe and O are added to control the crystal orientation, the crystal grain size, etc. to improve the mechanical characteristics are disclosed.

Further, in Patent Literature 11, the texture that an α+β titanium alloy hot-rolled sheet should have in order to ensure high cold ductility is described, and a technology, in which the cold ductility and the coil treatability in cold working are improved when the hot-rolled sheet has a developed T-texture, is disclosed. Thus, it is presumed that the cold ductility of a titanium alloy hot-rolled sheet having chemical components and a texture described in Patent Literature 11 will be good and a thin cold-rolled product can be produced relatively easily. However, when the α+β titanium alloy described in Patent Literature 3 to Patent Literature 11 is cold rolled and then annealed, depending on the combination conditions of cold rolling and annealing, it is likely that a basal-texture (B-texture) in which the c-axis of HCP is orientated in a direction close to the direction normal to the sheet will be produced, and the T-texture produced by unidirectional hot rolling will be damaged; hence, it has been difficult to maintain a high strength and a high Young's modulus in the sheet width direction.

CITATION LIST

Patent Literature

Patent Literature 1: JP 2012-132057A
Patent Literature 2: WO 2011/068247A1
Patent Literature 3: JP 3426605B
Patent Literature 4: JP H10-265876A
Patent Literature 5: JP 2000-204425A
Patent Literature 6: JP 2008-127633A
Patent Literature 7: JP 2010-121186A
Patent Literature 8: JP 2010-31314A
Patent Literature 9: JP 2009-179822A
Patent Literature 10: JP 2008-240026A
Patent Literature 11: WO 2012/115242A1

Non-Patent Literature

Non-Patent Literature 1: The Japan Titanium Society (Apr. 28, 2006), "TITANIUM JAPAN" Vol. 54, No. 1, pp. 42 to 51

SUMMARY OF INVENTION

Technical Problem

A problem to be solved by the present invention is to provide a high-strength α+β titanium alloy cold-rolled and annealed sheet that has a high strength and a high Young's modulus in the sheet width direction and is a thin material and a method for producing the same.

Solution to Problem

The present inventors conducted extensive studies on the relationship between strength and texture in the sheet width direction in the α+β alloy cold-rolled and annealed sheet, and have found that, when a unidirectionally cold-rolled and annealed sheet has a strong T-texture, the HCP bottom plane is oriented more strongly in the sheet width direction and thereby the strength in the sheet width direction is increased, and 900 MPa or more, which is regarded as a high strength, and 130 GPa or more, which is regarded as a high Young's modulus, are obtained.

Furthermore, it has also been found that, in the α+β titanium alloy, when the rate of decrease in sheet thickness during cold rolling (hereinafter, cold rolling rate=(sheet thickness before cold rolling−sheet thickness after cold rolling)/sheet thickness before cold rolling×100(%)) is high, a B-texture is produced and a T-texture is not obtained depending on the conditions of subsequent annealing. Thus, the present inventors conducted extensive studies on the titanium alloy cold-rolled and annealed sheet, and have revealed the mechanism of the production of a B-texture and have found out the production conditions whereby a strong T-texture can be maintained, by controlling the cold rolling rate and the annealing conditions.

Furthermore, the present inventors have found that, by optimizing the combination and the amounts of addition of alloy elements, the T-texture is further developed in the titanium alloy cold-rolled and annealed sheet and thus the effect mentioned above can be enhanced, and a tensile strength of 900 MPa or more and a Young's modulus of 130 GPa or more can be obtained in the sheet width direction.

The present invention has been made in view of the above circumstances, and provides an α+β titanium alloy cold-rolled and annealed sheet having a high strength and a high Young's modulus in the sheet width direction by maintaining a strong T-texture after performing cold rolling and annealing and a method for producing the same. In particular, when cold rolling is performed at a high rate of decrease in sheet thickness and then annealing is performed, the texture mentioned above is damaged and is likely to turn into a B-texture; thus, it becomes possible for a T-texture to be stably maintained by prescribing the cold rolling rate and the conditions of subsequent annealing. The present invention has been made based on these findings.

That is, the gist of the present invention is as follows.

[1]

An α+β titanium alloy cold-rolled and annealed sheet having a high strength and a high Young's modulus in a sheet width direction, consisting of, in mass %, Fe: 0.8% to 1.5%, N: 0.020% or less, and the balance: Ti and impurities, and satisfying Q shown in Formula (1) below=0.34 to 0.55, wherein, when a texture in a sheet plane direction is analyzed, assuming that a normal-to-rolling-plane direction of a cold-rolled and annealed sheet is denoted by ND, a sheet longitudinal direction is denoted by RD, the sheet width direction is denoted by TD, a direction normal to a (0001) plane of an α-phase is taken as a c-axis direction, an angle between the c-axis direction and ND is denoted by θ, an angle between a line of projection of the c-axis direction onto the sheet plane and the sheet width direction (TD) is denoted by φ, a strongest intensity out of (0002)-reflection relative intensities of X-rays caused by crystal grains falling within a range of angle θ of not less than 0 degrees and not more than 30 degrees and angle φ of −180 degrees to 180 degrees is denoted by XND, and a strongest intensity out of (0002)-reflection relative intensities of X-rays caused by crystal grains falling within a range of angle θ of not less than 80 degrees and less than 100 degrees and angle φ of ±10 degrees is denoted by XTD, a ratio XTD/XND is 5.0 or more, $$Q=[O]+2.77*[N]+0.1*[Fe] \quad (1)$$

where [Fe], [O], and [N] represent the amounts of the respective elements contained [mass %].

[2]

A method for producing the α+β titanium alloy cold-rolled and annealed sheet having a high strength and a high Young's modulus in a sheet width direction according to [1], the method comprising:

producing an α+β titanium alloy cold-rolled and annealed sheet by performing unidirectional cold rolling in the same direction as a direction of hot rolling and annealing using, as a material, a unidirectionally hot-rolled sheet consisting of, in mass %, Fe: 0.8% to 1.5%, N: 0.020% or less, and the balance: Ti and impurities, and satisfying Q shown in Formula (1) below=0.34 to 0.55, wherein annealing for a holding time of not less than t of Formula (2) below is performed at not less than 500° C. and less than 800° C. in a case where a cold rolling rate of the unidirectional cold rolling is less than 25% and annealing for a holding time of not less than t of Formula (2) below is performed at not less than 500° C. and less than 620° C. in a case where the cold rolling rate is 25% or more, $$t=\exp(19180/T-15.6) \quad (2)$$

where t: holding time (s), and T: holding temperature (K).

Advantageous Effects of Invention

According to the present invention, a high-strength α+β titanium alloy cold-rolled and annealed sheet product that has a high strength and a high Young's modulus in the sheet width direction and is a thin material and a method for producing the same are provided.

DESCRIPTION OF EMBODIMENTS

In order to solve the above mentioned problem, the present inventors investigated in detail the influence of the hot rolling texture on the strength in the sheet width direction of a titanium alloy cold-rolled and annealed sheet, and have found that a high strength and a high Young's modulus are obtained by stabilizing the T-texture. The present invention has been made based on this finding. The reason why the texture of the titanium α-phase is limited in the α+β titanium alloy cold-rolled and annealed sheet of the present invention will now be described.

Figure 1:
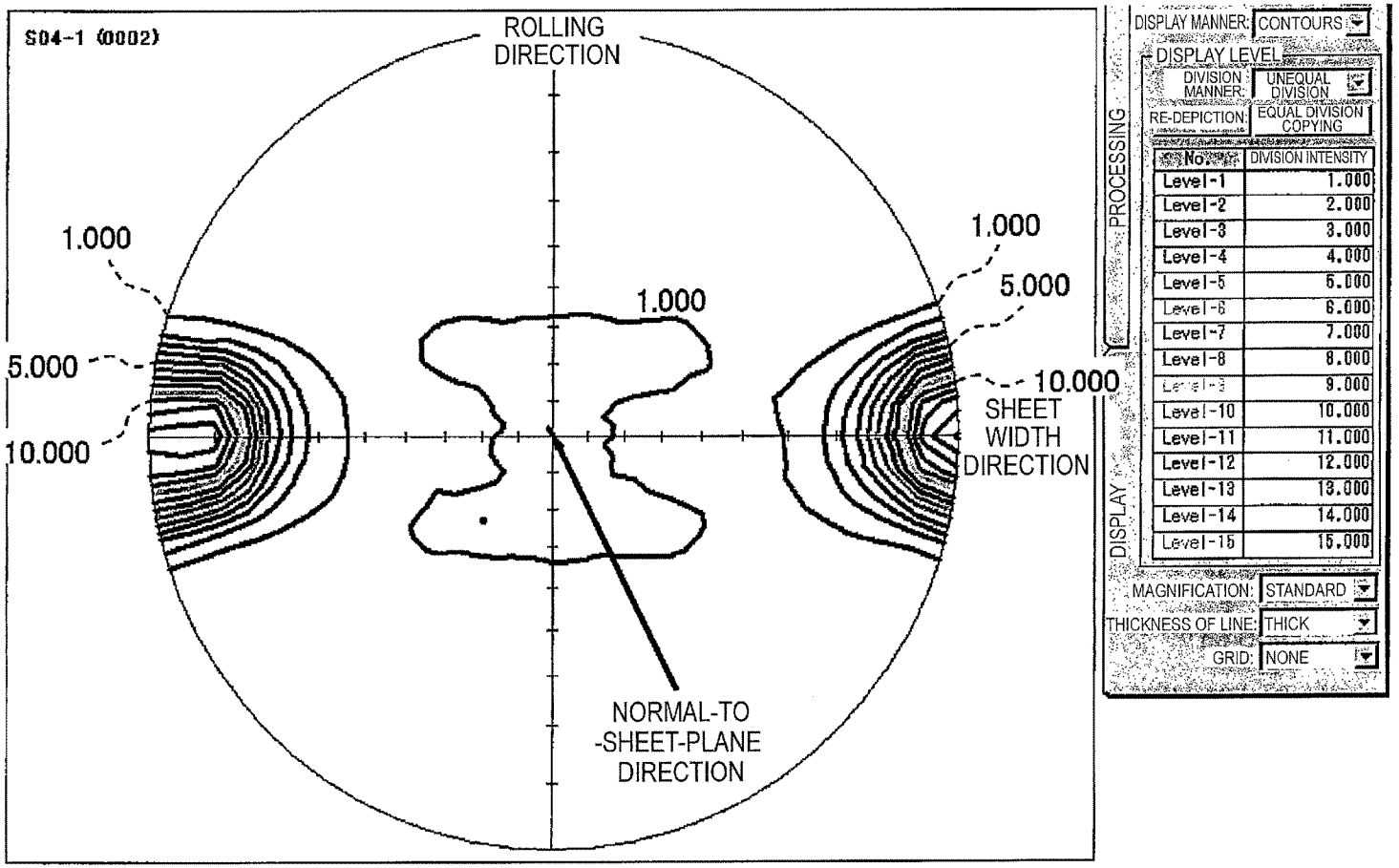
FIG. 1 is an example of the (0002) pole figure of a titanium α-phase.

In the α+β titanium alloy cold-rolled and annealed sheet, the effect of enhancing the strength and the Young's modulus in the sheet width direction is exhibited when the T-texture is developed most strongly. The present inventors conducted extensive studies on the alloy design and the texture formation conditions with which the T-texture is developed, and have solved the problem as follows. First, the degree of texture development has been assessed using the ratio of X-ray relative intensity from the α-phase bottom plane obtained by the X-ray diffraction method. In FIG. 1, an example of the (0002) pole figure showing the integrated orientation of the α-phase bottom plane is shown; in the (0002) pole figure, which is a typical example of the T-texture, the bottom plane (the (0001) plane) is strongly oriented in the sheet width direction.

Figure 2:
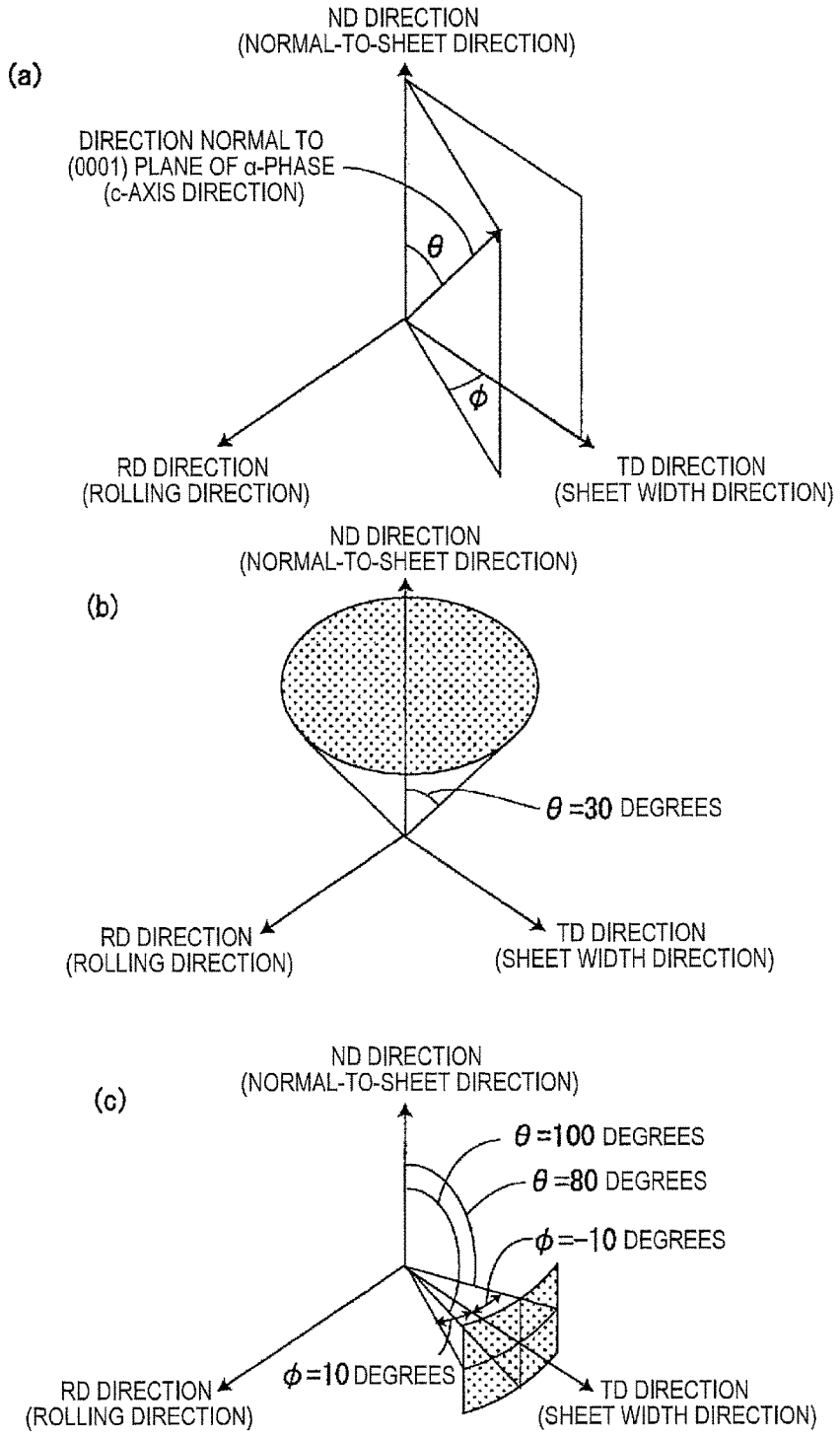
FIG. 2 is a diagram describing the crystal orientation of an α+β titanium alloy sheet.

Herein, the direction normal to the rolling plane of the cold-rolled and annealed sheet is denoted by ND, the sheet longitudinal direction (rolling direction) is denoted by RD, and the sheet width direction is denoted by TD (FIG. 2(*a*)). Further, the direction normal to the (0001) plane of the α-phase is taken as the c-axis direction. The angle between the c-axis direction and ND is denoted by θ, and the angle between the line of projection of the c-axis direction onto the sheet plane and the sheet width direction (TD) is denoted by φ. The strongest intensity out of the (0002)-reflection relative intensities of X-rays caused by crystal grains falling within the range of, as shown by the hatched portion of FIG. 2(*b*), angle θ of not less than 0 degrees and not more than 30 degrees and angle φ of the entire round (−180 degrees to 180 degrees) is denoted by XND. Further, the strongest intensity out of the (0002)-reflection relative intensities of X-rays caused by crystal grains falling within the range of, as shown by the hatched portion of FIG. 2(*c*), angle θ of not less than 80 degrees and less than 100 degrees and angle φ of ±10 degrees is denoted by XTD.

The above is a typical example of the T-texture, and a texture in which the bottom plane (the (0001) plane) is strongly oriented in the sheet width direction is characterized by the ratio XTD/XND. The ratio XTD/XND is referred to as an X-ray anisotropy index, and the degree of stability of the T-texture can be assessed by the index.

Figure 3:
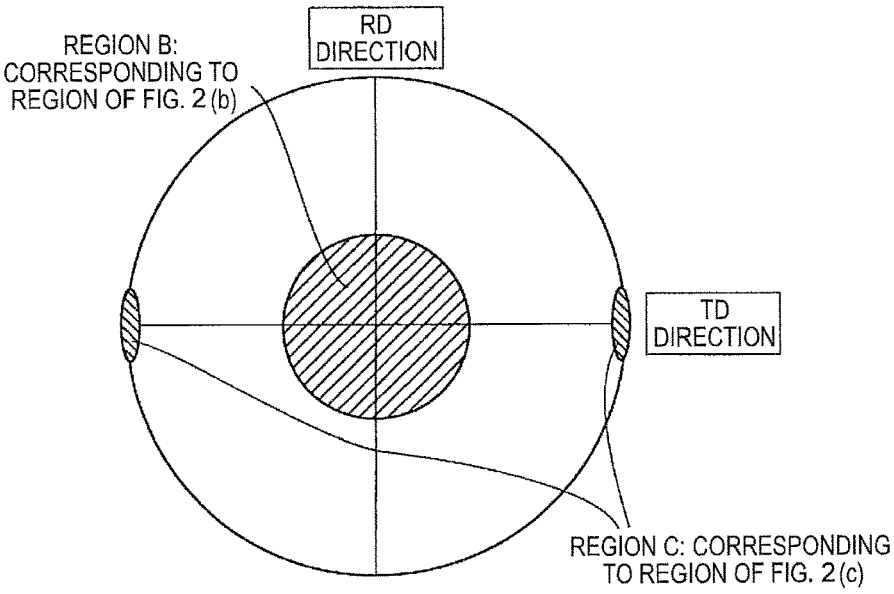
FIG. 3 is a schematic diagram showing the measuring positions of XTD and XND in the (0002) pole figure of the titanium α-phase.

On such a (0002) pole figure of the α-phase, the ratio (XTD/XND) between the X-ray relative intensity peak value (XTD) in directions close to the sheet width direction and the X-ray relative intensity peak value (XND) in directions close to the normal-to-sheet-plane direction has been investigated for various titanium alloy cold-rolled and annealed sheets. FIG. 3 schematically shows the measuring positions of XTD and XND.

Figure 4:
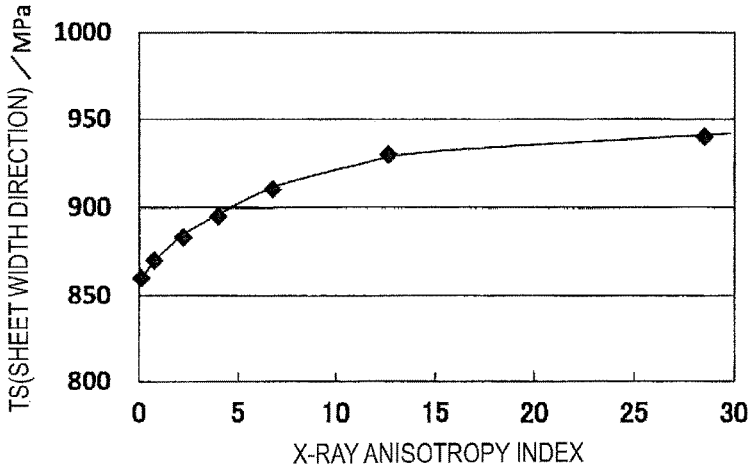
FIG. 4 is a diagram showing the relationship between the X-ray anisotropy index and the tensile strength (TS) in the sheet width direction.

Further, the X-ray anisotropy index mentioned above has been correlated with the strength in the sheet width direction. Tensile strengths in the sheet width direction in cases where various X-ray anisotropy indices are exhibited are shown in FIG. 4. As the X-ray anisotropy index becomes higher, the tensile strength in the sheet width direction becomes higher. For the α+β alloy cold-rolled and annealed sheet, the tensile strength regarded as high strength in the sheet width direction is 900 MPa. The X-ray anisotropy index at this time is 5.0 or more. Based on these findings, the lower limit of XTD/XND is limited to 5.0.

Further, in the present invention, the chemical components of the α+β alloy having a high strength and a high Young's modulus in the sheet width direction are prescribed. The reason for selecting the contained elements and the reason for limiting the component range in the present invention will now be described. The "%" for the component range refers to mass %.

Fe is an inexpensive additive element among β-phase stabilizing elements, and has the action of strengthening the β-phase by solid solution strengthening. To obtain a strong T-texture in a cold-rolled and annealed sheet, it is necessary to obtain a stable β-phase at an appropriate quantitative ratio at the hot rolling heating temperature and during the annealing after cold rolling. Fe has the characteristic that β-stabilizing capability is higher than those of other β-stabilizing elements. Therefore, the amount of added Fe can be made smaller than those of other β-stabilizing elements, and the solid solution strengthening at room temperature by Fe is not increased so much; thus, ductility in the sheet width direction can be ensured. To obtain a stable β-phase up to an appropriate volume ratio in the hot rolling temperature range and during the annealing after cold rolling, 0.8% or more Fe addition is necessary. On the other hand, Fe is likely to solidify and segregate in Ti, and when added in a large amount, reduces the ductility due to solid solution strengthening and also reduces the Young's modulus because of the increase of the β-phase ratio. In view of these influences, the upper limit of the amount of added Fe is set to 1.5%.

N has the action of being dissolved as an interstitial solid solution in the α-phase and strengthening the α-phase. However, when N is added above 0.020% by a common method, such as using sponge titanium containing a high concentration of N, it is likely that an unmelted inclusion called an LDI will be produced, and the yield of the product will be reduced; hence, 0.020% is taken as the upper limit. N is not necessarily contained.

O has the action of, similarly to N, being dissolved as an interstitial solid solution in the α-phase and strengthening the α-phase. These elements, including Fe having the action of being dissolved as a substitutional solid solution in the β-phase and strengthening the β-phase, contribute to increasing the strength in accordance with the Q value shown in Formula (1) below. In this case, if the Q value is less than 0.34, a strength not less than approximately 900 MPa, which is the tensile strength in the sheet width direction required for the α+β alloy cold-rolled and annealed sheet, cannot be obtained; and if the Q value is more than 0.55, the T-texture is excessively developed, and the strength in the sheet width direction is increased too much and consequently the ductility is reduced. Thus, the lower limit of the Q value is set to 0.34, and the upper limit to 0.55.

$$Q=[O]+2.77*[N]+0.1*[Fe] \quad (1)$$

where [Fe], [O], and [N] represent the amounts of the respective elements contained [mass %].

In Formula (1), the coefficients of [N] and [Fe] in Q have been determined by assessing the equivalents of N and Fe to the solid solution strengthening capability by 1 mass % O, that is, the mass % of N and Fe providing a solid solution strengthening capability equivalent to the solid solution strengthening capability by 1 mass % O.

In the α+β alloy cold-rolled and annealed sheet of the present invention, the sheet thickness is preferably 2 mm or less. It is more preferably 1 mm or less. This is because the features of the present invention are exhibited in such a thin steel sheet.

Although a titanium alloy containing similar additive elements to those of the alloy of the present invention is described in Patent Literature 6, the amount of added O is lower and the strength range is lower than those of the alloy of the present invention; hence, both are different. Further, Patent Literature 6 aims at making the material anisotropy as low as possible in order to improve mainly the stretch-expand forming performance in cold working; also from this point of view, Patent Literature 6 is quite different from the alloy of the present invention.

Next, a production method of the present invention relates to a production method for, particularly in a cold-rolled and annealed sheet, maintaining a strong T-texture to ensure a high strength and a high Young's modulus in the sheet width direction. In the production method of the present invention, when performing unidirectional cold rolling in the same direction as that of hot rolling using, as the material, a unidirectionally hot-rolled sheet having the chemical composition mentioned above, annealing for a holding time of not less than t of Formula (2) is performed at not less than 500° C. and less than 800° C. in the case where the cold rolling rate is less than 25%, and annealing for a holding time of not less than t of Formula (2) is performed at not less than 500° C. and less than 620° C. in the case where the cold rolling rate is 25% or more.

$$t=\exp(19180/T-15.6) \quad (2)$$

where t: holding time (s), and T: holding temperature (K).

For the titanium alloy sheet in the present invention, it is important to be a cold-rolled sheet having a T-texture in its texture. The texture of the hot-rolled sheet that is the source material of the cold-rolled sheet is not particularly restricted. However, to ensure a strong T-texture in a cold-rolled and annealed sheet, it is preferable that a strong T-texture be present in the hot-rolled sheet used as the material. This is preferable also from the viewpoint of the cold rolling processability of the hot-rolled sheet. To this end, it is preferable that unidirectional hot rolling be performed such that the pre-hot-rolling heating temperature is not less than the β-transformation temperature and not more than the β-transformation temperature+150° C., the rate of decrease in sheet thickness is 80% or more, and the finishing temperature is a temperature of not more than the β-transformation temperature−50° C. and not less than the β-transformation temperature−200° C. Here, the strong T-texture in the hot-rolled sheet refers to one in which, when the texture in the sheet plane direction is analyzed by X-rays, assuming that, on the (0002) pole figure of titanium, the X-ray relative intensity peak value in the angles of direction inclined by 0 to 10° from the sheet width direction to the normal-to-sheet direction and in the angles of direction rotated by ±10° from the sheet width direction with the normal-to-sheet direction as the central axis is denoted by XTD and the X-ray relative intensity peak value in the angles of direction inclined by 0 to 30° from the normal-to-sheet direction to the sheet width direction and in the angles of direction rotated all around with the normal to the sheet as the central axis is denoted by XND, the ratio XTD/XND is 5.0 or more. However, even when this is used as the start material, if the cold rolling direction is set to a direction crossing the hot rolling direction, a B-texture is developed and the target material characteristics are not obtained. Thus, to obtain a strong T-texture after unidirectional cold rolling, the unidirectional cold rolling needs to be performed in the same direction as that of hot rolling.

In the case where, when a hot-rolled sheet having a strong T-texture is used as the material for cold rolling, the cold rolling rate during unidirectional cold rolling is less than 25%, the T-texture is maintained without being influenced by the conditions of subsequent annealing, and therefore a high strength and a high Young's modulus are obtained in the sheet width direction. This is because the processing strain introduced by cold rolling is not enough to produce recrystallization and only recovery occurs, and thus a change in crystal orientation does not occur. Therefore, in the case where the cold rolling rate is less than 25%, even when annealing is performed in a wide condition range, the T-texture is maintained and a high strength in the sheet width direction can be ensured. In this case, when annealing is performed at 500° C. or less, there are possibilities that a long time will be needed until recovery and the productivity will be greatly reduced, and that an Fe—Ti intermetallic compound will be produced during the long-time holding and the ductility will be reduced; thus, 500° C. or more is used. Preferably 550° C. or more is used. Further, when annealing is performed at 800° C. or more, the β-phase fraction during holding may be increased, and this portion may become an acicular structure during cooling after the holding; consequently, the ductility may be reduced. Thus, the upper limit of the holding temperature is less than 800° C. It is preferably 750° C.

The holding time until recovery occurs in the annealing of the cold-rolled sheet is the time t shown by Formula (2); thus, holding for a period not less than the time t shown in Formula (2) is performed. In the present invention, no upper limit is provided on the holding time, but a short time is preferable from the viewpoint of productivity. In order to avoid the case where an Fe—Ti intermetallic compound is deposited and the ductility is reduced as mentioned above, the holding time is preferably at least shorter than 10,000 seconds, which is an approximate value in Formula (2) at 500° C. It is more preferably 9500 seconds or less.

On the other hand, in the case where the cold rolling rate is 25% or more, even when the hot-rolled sheet material has a strong T-texture, a B-texture is developed and the strength and the Young's modulus in the sheet width direction are reduced, depending on the annealing conditions. This is because the strain introduced by cold rolling is high enough to produce recrystallization, and therefore recrystallization grains having the main component orientation of the B-texture are produced during annealing and a recrystallization texture develops with the annealing time. In order to prevent recrystallization and bring about only recovery in this case, annealing holding may be performed at not less than 500° C. and less than 620° C. for a period not less than t of Formula (2). In this case, if annealing is performed for a holding time of less than t of Formula (2), sufficient recovery does not occur and thus the ductility is not improved. Further, if annealing is performed at 620° C. or more, recrystallization occurs and a B-texture is produced, and consequently the strength and the Young's modulus in the sheet width direction are reduced. Thus, annealing at not less than 500° C. and less than 620° C. for a holding time of not less than t of Formula (2) is effective. In this case, although the T-texture is maintained also when heating is performed at 500° C. or less and holding is performed for a long time, the minimum holding time t shown in Formula (2) is prescribed with consideration of productivity and economy, because a period not less than t of Formula (2) is enough to bring about recovery, which is an objective of annealing, sufficiently.

EXAMPLES

Example 1

A titanium material having each of the compositions shown in Table 1 was melted by the vacuum arc melting method, the test piece was hot rolled into slabs, heating was performed to a hot rolling heating temperature of 915° C., and then hot rolling was performed to obtain a 3-mm hot-rolled sheet. The unidirectionally hot-rolled sheet was annealed at 750° C. for 60 s and was then pickled to remove the oxidized scales, and the test piece was cold rolled; then, various characteristics were evaluated.

For test numbers 3 to 14 shown in Table 1, in the cold rolling process, unidirectional cold rolling was performed at a cold rolling rate of 35% in the same direction as that of the unidirectional hot rolling. For test numbers 1 and 2, cold rolling in the sheet width direction perpendicular to the hot rolling direction was performed at a cold rolling rate of 35% likewise. After the cold rolling, annealing based on 600° C. and 30-minute holding was performed.

TABLE 1

| Test No. | Fe (mass %) | O (mass %) | N (mass %) | Q (mass %) | β-Transformation temperature (° C.) | X-ray anisotropy index (XTD/XND) | Tensile strength in sheet width direction (MPa) | Young's modulus in sheet width direction (GPa) | Notes |
|---|---|---|---|---|---|---|---|---|---|
| 1 | 1.1 | 0.32 | 0.001 | 0.43 | 915 | 0.52 | 830 | 117 | Comparative Example |
| 2 | 0.9 | 0.35 | 0.004 | 0.45 | 923 | 1.89 | 878 | 125 | Comparative Example |
| 3 | 0.2 | 0.34 | 0.002 | 0.37 | 934 | 6.12 | 834 | 125 | Comparative Example |
| 4 | 1.0 | 0.34 | 0.002 | 0.45 | 919 | 11.08 | 917 | 132 | Present invention |
| 5 | 1.3 | 0.34 | 0.002 | 0.48 | 914 | 17.58 | 934 | 133 | Present invention |
| 6 | 1.9 | 0.34 | 0.002 | 0.54 | 903 | 9.11 | 1067 | 132 | Comparative Example |
| 7 | 1.0 | 0.18 | 0.003 | 0.29 | 900 | 6.18 | 827 | 126 | Comparative Example |
| 8 | 1.0 | 0.36 | 0.003 | 0.47 | 922 | 11.89 | 938 | 133 | Present invention |
| 9 | 1.0 | 0.49 | 0.003 | 0.60 | 938 | 18.64 | 1055 | 137 | Comparative Example |
| 10 | 1.1 | 0.35 | 0.001 | 0.46 | 919 | 27.68 | 936 | 134 | Present invention |
| 11 | 1.1 | 0.35 | 0.004 | 0.47 | 920 | 18.96 | 946 | 134 | Present invention |
| 12 | 1.1 | 0.35 | 0.044 | 0.58 | 925 | — | — | — | Comparative Example |
| 13 | 0.9 | 0.37 | 0.001 | 0.46 | 925 | 21.23 | 965 | 137 | Present invention |
| 14 | 0.9 | 0.32 | 0.001 | 0.41 | 918 | 10.16 | 923 | 133 | Present invention |

Q = [O] + 2.77 * [N] + 0.1 * [Fe]

A tensile test piece was taken from each of these cold-rolled and annealed sheets and tensile characteristics were investigated, and the degree of texture development was assessed using, as the X-ray anisotropy index, the ratio XTD/XND between the X-ray relative intensity peak value (XTD) in the angles of direction inclined by 0 to 10° from the sheet width direction to the normal-to-sheet direction and in the angles of direction rotated by ±10° from the sheet width direction with the normal-to-sheet direction as the central axis and the X-ray relative intensity peak value (XND) in the angles of direction inclined by 0 to 30° from the normal-to-sheet direction to the sheet width direction and in the angles of direction rotated all around with the normal to the sheet as the central axis on the (0002) pole figure of the α-phase based on the X-ray diffraction method.

In Table 1, test numbers 1 and 2 are results in α+β titanium alloys in which unidirectional cold rolling was performed in the sheet width direction of the unidirectionally hot-rolled sheet. In both of test numbers 1 and 2, the strength in the sheet width direction is below 900 MPa and also the Young's modulus in the sheet width direction is below 130 GPa, and neither a sufficient strength nor a sufficient Young's modulus has been obtained. In both of these materials, the value of XTD/XND is below 5.0, and a T-texture has not been developed.

In contrast, in test numbers 4, 5, 8, 10, 11, 13, and 14, which are Examples of the present invention produced by the production method of the present invention, the strength in the sheet width direction is above 900 MPa and also the Young's modulus is more than 130 GPa, and good characteristics have been obtained.

On the other hand, in test numbers 3 and 7, the strength is low and the tensile strength in the sheet width direction has not reached 900 MPa. Of them, in test number 3, since the amount of added Fe was below the lower limit value of the present invention, the tensile strength was reduced. Further, in test number 7, since particularly the amounts of contained nitrogen and oxygen were low and the oxygen-equivalent value Q was below the lower limit value of the prescribed amount, the tensile strength has not reached a sufficiently high level.

In test numbers 6 and 9, although the X-ray anisotropy index is above 5.0 and also the tensile strength in the sheet width direction is more than 900 MPa, the total elongation in the sheet width direction is only approximately 5% and the ductility is not sufficient. This is because, in test numbers 6 and 9, addition was performed such that the amount of added Fe and the Q value exceeded the upper limit values of the present invention, respectively; therefore, the α-phase was strengthened excessively by solid solution strengthening and the T-texture was developed excessively; consequently, the strength was increased too much and the ductility was reduced.

On the other hand, in test number 12, many defects occurred in many parts of the hot-rolled sheet and the yield of the product was low, and hence the characteristics were not able to be evaluated. This is because N was added above the upper limit of the present invention by a common method, such as using a high-nitride sponge, and consequently a large number of LDIs occurred.

From the above results, a titanium alloy thin sheet having the amounts of contained elements and the XTD/XND prescribed by the present invention exhibits good characteristics, that is, the tensile strength in the sheet width direction being 900 MPa or more and the Young's modulus in the sheet width direction being 130 GPa or more; on the other hand, when the amounts of alloy elements and the XTD/XND are outside those prescribed by the present invention, satisfactory good characteristics cannot be obtained (e.g., the strength and the Young's modulus in the sheet width direction are low).

Example 2

A titanium material having each of the compositions of test numbers 4 and 11 of Table 1 was melted and the test piece was hot rolled into slabs, and one of the slabs was subjected to unidirectional hot rolling into a hot-rolled sheet with a thickness of 3.0 mm; then annealing at 800° C. held for 60 seconds and pickling were performed, and after that cold rolling and annealing were performed under the conditions shown in Tables 2 and 3; and the test piece was used to investigate the tensile characteristics and calculate the X-ray anisotropy index to assess the degree of texture development in the sheet plane direction and the Young's modulus and the tensile strength in the sheet width direction, in a similar manner to Example 1. The results of assessment of these characteristics are shown in Tables 2 and 3 as well. Table 2 is the results in hot-rolled and annealed sheets of the composition shown in test number 4, and Table 3 is those in test number 11.

TABLE 2

| Test No. 4 in Table 1 | | | | | | | | |
|---|---|---|---|---|---|---|---|---|
| Test No. | Cold rolling rate (%) | Annealing holding temperature (° C.) | Annealing holding time (s) | Minimum annealing holding time according to Formula (2) (s) | X-ray anisotropy index (XTD/XND) | Tensile strength in sheet width direction (MPa) | Young's modulus in sheet width direction (GPa) | Notes |
| 15 | 19.7 | 760 | 120 | 19 | 20.45 | 924 | 134 | Present invention (1), (2) |
| 16 | 48.6 | 600 | 900 | 582 | 9.76 | 912 | 131 | Present invention (1), (2) |
| 17 | 23.5 | 590 | 3600 | 751 | 23.58 | 925 | 135 | Present invention (1), (2) |
| 18 | 21.2 | 880 | 600 | 3 | 5.28 | 881 | 127 | Comparative Example |
| 19 | 36.5 | 475 | 900 | 22847 | 32.13 | 779 | 134 | Comparative Example |
| 20 | 36.5 | 590 | 3600 | 751 | 27.38 | 928 | 133 | Present invention (1), (2) |
| 21 | 36.5 | 680 | 600 | 92 | 4.29 | 887 | 128 | Comparative Example |
| 22 | 22.2 | 600 | 7200 | 582 | 18.17 | 924 | 133 | Present invention (1), (2) |
| 23 | 22.2 | 600 | 300 | 582 | 11.96 | 876 | 132 | Comparative Example |
| 24 | 45.5 | 600 | 30 | 582 | 17.88 | 796 | 132 | Comparative Example |
| 25 | 45.5 | 600 | 900 | 582 | 14.64 | 920 | 131 | Present invention (1), (2) |

β-Transformation temperature being 919° C.

TABLE 3

| Test No. 11 in Table 1 | | | | | | | | |
|---|---|---|---|---|---|---|---|---|
| Test No. | Cold rolling rate (%) | Annealing holding temperature (° C.) | Annealing holding time (s) | Minimum annealing holding time according to Formula (2) (s) | X-ray anisotropy index (XTD/XND) | Tensile strength in sheet width direction (MPa) | Young's modulus in sheet width direction (GPa) | Notes |
| 26 | 52.1 | 580 | 3600 | 974 | 13.23 | 937 | 133 | Present invention (1), (2) |
| 27 | 20.1 | 770 | 60 | 16 | 27.44 | 938 | 135 | Present invention (1), (2) |
| 28 | 19.8 | 650 | 1800 | 177 | 18.59 | 932 | 133 | Present invention (1), (2) |
| 29 | 22.3 | 890 | 360 | 2 | 5.07 | 873 | 126 | Comparative Example |
| 30 | 44.4 | 465 | 720 | 32334 | 30.17 | 746 | 131 | Comparative Example |
| 31 | 44.4 | 600 | 1800 | 582 | 12.13 | 936 | 132 | Present invention (1), (2) |
| 32 | 22.2 | 660 | 7200 | 142 | 21.33 | 939 | 134 | Present invention (1), (2) |
| 33 | 22.2 | 660 | 30 | 142 | 20.17 | 764 | 133 | Comparative Example |
| 34 | 50.1 | 575 | 120 | 1112 | 20.77 | 844 | 133 | Comparative Example |
| 35 | 50.1 | 575 | 7200 | 1112 | 10.18 | 929 | 132 | Present invention (1), (2) |
| 36 | 50.1 | 700 | 90 | 61 | 4.11 | 876 | 125 | Comparative Example |

β-Transformation temperature being 920° C.

Of them, in test numbers 15, 16, 17, 20, 22, 25, 26, 27, 28, 31, 32, and 35, which are Examples of the present invention produced by the production method of the present invention, the tensile strength in the sheet width direction is more than 900 MPa and the Young's modulus is more than 130 GPa, and good rigidity and strength have been obtained.

On the other hand, test numbers 18, 19, 21, 23, 24, 29, 30, 33, 34, and 36 have either or both of a tensile strength in the sheet width direction of less than 900 MPa and a Young's modulus in the sheet width direction of less than 130 GPa, and are difficult to employ for use, in which strength and rigidity are needed in one direction.

Of them, for test numbers 18 and 29, the reason for the results is that the cold rolling rate was not more than 25% and the annealing temperature was higher than the upper limit of the present invention; therefore, the β-phase fraction became too high and the most part became an acicular structure during the annealing holding, and the ductility in the sheet width direction was reduced; consequently, the tensile strength in this direction did not become sufficiently high.

In test numbers 19 and 30, the annealing temperature was not more than the lower limit of the present invention, and in test numbers 23, 24, 33, and 34, the annealing holding time was not more than the lower limit of the present invention; thus, the reason for the results of these test numbers is that recovery did not occur sufficiently and the ductility was not sufficient, and consequently the tensile strength in the sheet width direction did not become sufficiently high.

For test numbers 21 and 36, the reason for the results is that, under the cold rolling rate condition of 25% or more, the annealing holding temperature was above the upper limit temperature of the present invention; therefore, recrystallization grains were produced and a recrystallization texture formed of a B-texture developed with the annealing time, and accordingly the anisotropy was reduced; consequently, neither the tensile strength nor the Young's modulus in the sheet width direction became sufficiently high.

From the above results, to obtain an α+β alloy thin sheet having characteristics of a high tensile strength and a high Young's modulus in the sheet width direction, a titanium alloy having a chemical composition and a texture in the ranges provided by the present invention may be cold rolled and annealed in accordance with the cold rolling rate and the annealing conditions provided by the present invention; thereby, the α+β alloy thin sheet mentioned above can be produced.

The hot-rolled sheets used in Examples 1 and 2 above had a strong T-texture in their texture. However, when the same test as those of test numbers 1 to 36 above was performed based on a hot-rolled sheet not having a strong T-texture which was produced using the same composition and different production conditions, although cold rolling processability was slightly inferior, almost the same results were obtained.

INDUSTRIAL APPLICABILITY

According to the present invention, an α+β titanium alloy cold-rolled and annealed sheet having a high Young's modulus and a high tensile strength in the sheet width direction can be produced. This can be widely used in fields in which strength and rigidity are required in one direction, such as uses of consumer products such as golf club faces and automobile parts.

The invention claimed is:

1. An α+β titanium alloy cold-rolled and annealed sheet, consisting of, in mass %, Fe: 0.8% to 1.5%, N: 0.020% or less, and the balance: Ti and impurities, and satisfying Q shown in Formula (1) below =0.34 to 0.55, wherein, when a texture in a sheet plane direction is analyzed, assuming that a normal-to-rolling-plane direction of a cold-rolled and annealed sheet is denoted by ND, a sheet longitudinal direction is denoted by RD, the sheet width direction is denoted by TD, a direction normal to a (0001) plane of an α-phase is taken as a c-axis direction, an angle between the c-axis direction and ND is denoted by θ, an angle between a line of projection of the c-axis direction onto the sheet plane and the sheet width direction (TD) is denoted by φ, a strongest intensity out of (0002)-reflection relative intensities of X-rays caused by crystal grains falling within a range of angle θ of not less than 0 degrees and not more than 30 degrees and angle φ of −180 degrees to 180 degrees is denoted by XND, and a strongest intensity out of (0002)-reflection relative intensities of X-rays caused by crystal grains falling within a range of angle θ of not less than 80 degrees and less than 100 degrees and angle φ of ±10 degrees is denoted by XTD, a ratio XTD/XND is 5.0 or more, $$Q = [O] + 2.77 * [N] + 0.1 * [Fe] \quad (1)$$

where [Fe], [O], and [N] represent the amounts of the respective elements contained [mass %], and wherein the α+β titanium alloy cold-rolled and annealed sheet has more than 130 GPa of Young's modulus and above 900 MPa of a tensile strength in the sheet width direction.

2. A method for producing the α+β titanium alloy cold-rolled and annealed sheet according to claim 1, the method comprising:

producing an α+β titanium alloy cold-rolled and annealed sheet by performing unidirectional cold rolling in the same direction as a direction of hot rolling and annealing using, as a material, a unidirectionally hot-rolled sheet consisting of, in mass %, Fe: 0.8% to 1.5%, N: 0.020% or less, and the balance: Ti and impurities, and satisfying Q shown in Formula (1) below =0.34 to 0.55, wherein annealing for a holding time of not less than t of Formula (2) below is performed at not less than 500° C. and less than 800° C. in a case where a cold rolling rate of the unidirectional cold rolling is less than 25% and annealing for a holding time of not less than t of Formula (2) below is performed at not less than 500° C. and less than 620° C. in a case where the cold rolling rate is 25% or more, $$Q = [O] + 2.77 * [N] + 0.1 * [Fe] \quad (1)$$

where [Fe], [O], and [N] represent the amounts of the respective elements contained [mass %], $$t = \exp(19180/T - 15.6) \quad (2)$$

where t: holding time (s), and T: holding temperature (K).

* * * * *